US007740134B2

(12) United States Patent
Sweeney, Jr. et al.

(10) Patent No.: US 7,740,134 B2
(45) Date of Patent: Jun. 22, 2010

(54) INFUSION CAP WITH RESERVOIR SHIFTABLE DOWNWARDLY

(75) Inventors: Theodore J. Sweeney, Jr., Grosse Pointe Farms, MI (US); Drew J. Smith, Bloomfield Hills, MI (US)

(73) Assignee: Theodore Sweeney & Company, Clinton Township, MI (US)

( * ) Notice: Subject to any disclaimer, the term of this patent is extended or adjusted under 35 U.S.C. 154(b) by 1070 days.

(21) Appl. No.: 11/436,827

(22) Filed: May 18, 2006

(65) Prior Publication Data

US 2007/0267442 A1 Nov. 22, 2007

(51) Int. Cl.
*B65D 25/08* (2006.01)

(52) U.S. Cl. ..... 206/221; 215/DIG. 8

(58) Field of Classification Search ..... 206/219–221, 206/222; 215/DIG. 8; 222/129
See application file for complete search history.

(56) References Cited

U.S. PATENT DOCUMENTS 2,859,898 A 11/1958 Mendenhall
3,079,022 A 2/1963 Tompkins
4,793,475 A 12/1988 Itzel
5,433,328 A * 7/1995 Baron et al. ..... 215/DIG. 8
5,465,835 A 11/1995 Schumacher et al.
5,967,309 A 10/1999 Robles-Gonzalez et al.
6,068,396 A * 5/2000 Baudin ..... 206/219
6,293,433 B1 * 9/2001 Joulia ..... 222/129
6,372,270 B1 4/2002 Denny
6,820,740 B1 11/2004 Spector
6,840,373 B2 1/2005 Gibler et al.
6,994,211 B2 * 2/2006 Cho ..... 206/221
7,055,685 B1 * 6/2006 Patterson et al. ..... 206/220
7,464,811 B2 * 12/2008 Patterson et al. ..... 206/220
7,578,386 B2 * 8/2009 Im ..... 206/221
2005/0218015 A1 10/2005 Spector

FOREIGN PATENT DOCUMENTS

EP 333541 A1 * 9/1989

* cited by examiner

*Primary Examiner*—Bryon P Gehman
(74) *Attorney, Agent, or Firm*—Brooks Kushman P.C.

(57) ABSTRACT

An infusion cap for a bottle having a threaded neck is screwed onto the threaded neck and by removing a locking tab a portion of the cap may be pressed toward the bottle to discharge an infusion substance into the bottle. In a modified embodiment instead of pushing against the cap, a portion of the cap is rotated on the bottle threads to discharge a substance to be infused from the cap into the bottle.

6 Claims, 4 Drawing Sheets

INFUSION CAP WITH RESERVOIR SHIFTABLE DOWNWARDLY

BACKGROUND OF THE INVENTION

1. Field of the Invention

This invention relates to a bottle closure cap which contains an infusion substance in a reservoir in the cap, and when desired the infusion substance may be deposited in the bottle to mix with the material contained in the bottle without removing the cap from the bottle.

2. Background Art

The prior art shows several approaches to providing an infusion cap with the infusion material stored in the cap dispensed into the bottle or container for mixing with the liquid or other substance in the bottle. Typical of the prior art are the following U.S. Pat. Nos. 2,859,898, 3,079,022, 4,793,475, 5,465,835, 5,967,309, 6,372,270, 6,820,740, 6,840,373 B2, and U.S. Patent Application Publication No. 2005/0218015 A1.

SUMMARY OF THE INVENTION

We have disclosed three embodiments of the invention. In each instance, the infusion cap comprises cooperating parts which have been molded of plastic and assembled to provide a reservoir for containing the infusion material with two of the embodiments utilizing a cap which the user will press toward the bottle or other container on which the cap is mounted causing displacement of parts in the infusion cap which releases the contents of the reservoir into the bottle. In two instances, the seal is broken by simply pushing on the cap toward the bottle while in the other embodiment, the seal is broken by rotating the cap downwardly on the threaded neck of the bottle. In all embodiments, provision is made to prevent accidental infusion of material in the reservoir into the bottle.

DETAILED DESCRIPTION OF THE PREFERRED EMBODIMENT(S)

Figure 1:
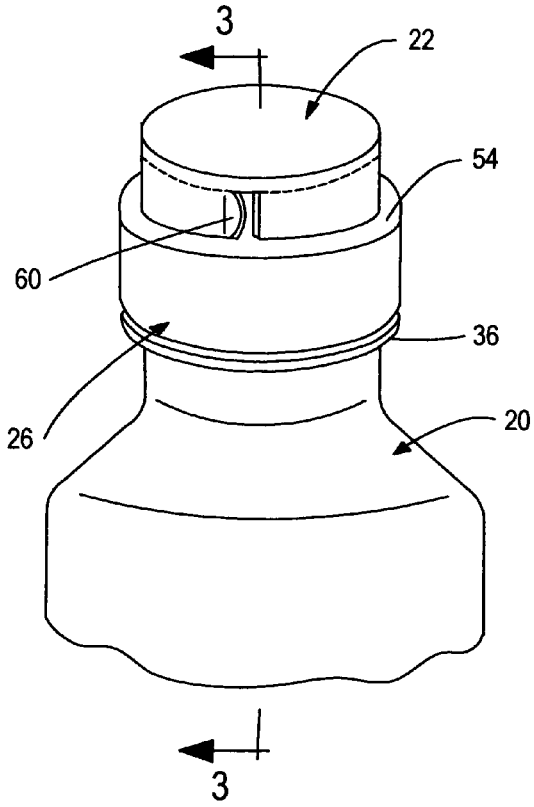
FIG. 1 shows a bottle having our improved infusion cap.

Referring to FIG. 1, we have shown a conventional bottle 20 upon which our infusion cap 22 is mounted. While we have referred to the container 20 as a "bottle," it is to be understood that it may be of any desired configuration and may not be a "bottle" as that term is normally used. At the time the bottle is filled, the infusion cap 22 may be locked on the neck 36 of the bottle in any suitable fashion, such as by threaded engagement of threads 34 on the bottle neck and within the cap at 32. Alternatively, the cap might be staked or otherwise permanently, non-rotatably secured in place on the bottle. This would be desirable where it is not necessary for the cap to be rotated relative to the bottle to dispense the infusion substance into the bottle as in the disclosure of FIGS. 1-5 and 9. The "bottle" 20 may be of plastic, glass, metal, or any other material appropriate for the circumstances.

The cap 22 may be placed on the bottle with the infusion substance in the cap at the time the bottle is filled with a substance with which the infusion material will be mixed. On the other hand, the bottle may be provided with a conventional cap and the user may remove such cap and place our infusion cap on the bottle and store it for future use. It is contemplated that the bottles may be of conventional design and configuration such as conventional water filled plastic bottles, beverage bottles and the like. Medicines may be dispensed with this system and even alcoholic beverages may be provided in which the alcohol is in the infusion cap and soda water or drinking water, or the like, in the bottle 20. Our infusion cap may find use where it is desirable to separate substances in the bottle from that in the infusion cap until the time for use of the mixture. The cap may contain liquid or powder substances as may the bottle itself.

In a first embodiment of our invention, the cap 22, comprises a barrel 26 having concentric inner and outer sleeve portions 28 and 30. The outer sleeve portion 30 is provided with internal threads 32 (see FIG. 3) matching the threads 34 on the bottle whereby the barrel may be threaded onto the threaded neck 36 of the bottle. The inner sleeve portion 28 telescopes down into the threaded neck of the bottle.

Figure 2:
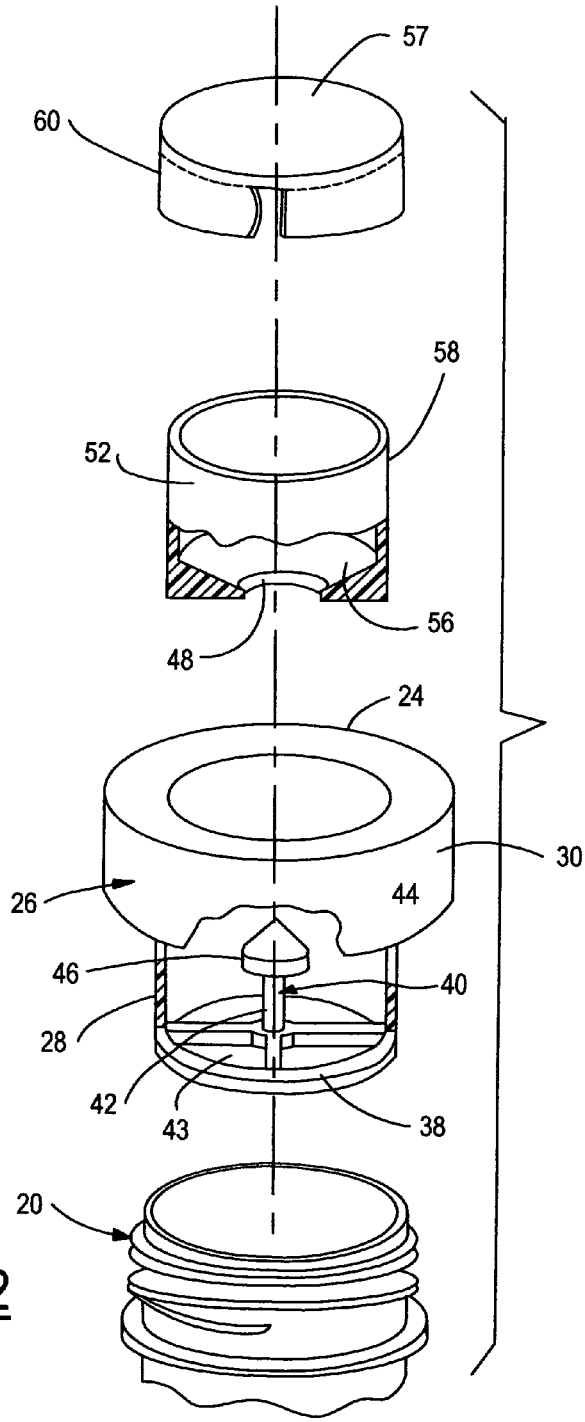
FIG. 2 is an exploded view of the components making up the infusion cap of FIG. 1.

The lower end of the inner sleeve portion 28 has a transverse wall or web 38 which is preferably integrally molded with the inner sleeve portion 28. A plunger 40 is integrally molded with the transverse wall 38. The plunger 40 is shown as having a vertical stem 42 terminating in a conically shaped head 44 atop a short cylindrical section 46 as shown in FIG. 2. As shown in the drawings, the inner and outer sleeve portions 28 and 30, the transverse wall or web 38, and the plunger 40, are all part of an integral barrel assembly. It is possible that in some instances, it may be desirable to have the plunger 40 formed separately and mounted in any suitable fashion on the transverse wall 38.

Figure 3:
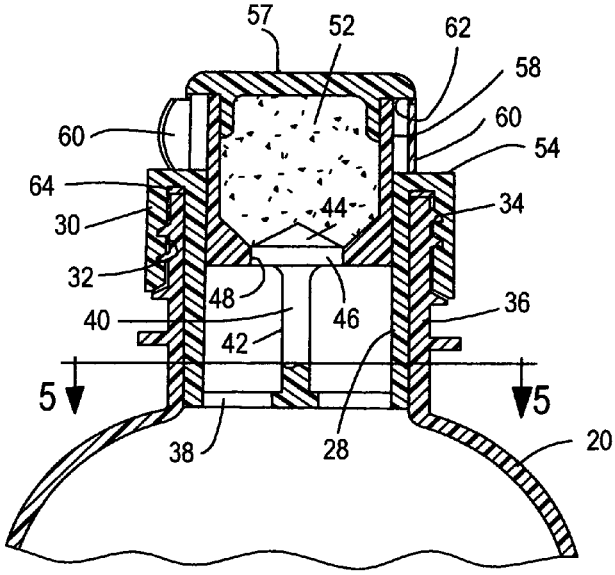
FIG. 3 is a cross-sectional view taken on the line 3-3 of FIG. 1.
Figure 4:
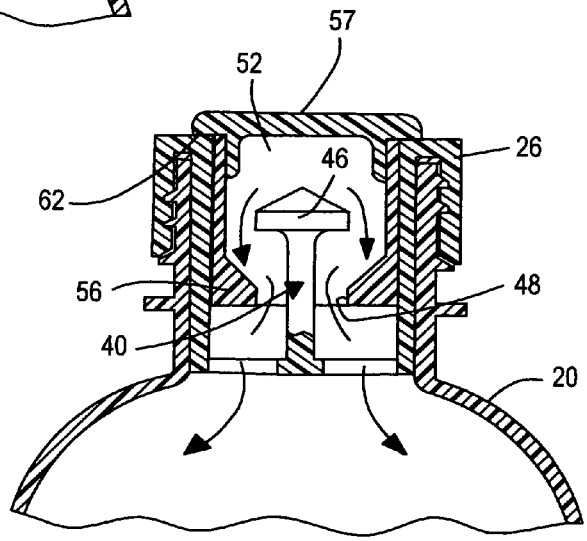
FIG. 4 shows the structure of FIG. 3 after the seal has been broken between the reservoir and the contents of the bottle.

The plunger 40 cooperates with an aperture 48 in an end wall 56 of a reservoir 52 which is concentric with the barrel 26. The reservoir has a cylindrical sleeve like portion 58 that is slidably supported in a press-fitted sealed relation within the inner sleeve portion 28 of the barrel. This sleeve-like portion extends above the upper end 54 of the barrel. The upper end of the reservoir is closed by a transverse wall 57 which extends radially outwardly beyond the reservoir wall 58. This permits a removable locking tab 60 to be disposed between the upper end 54 of the barrel and the overhanging shoulder 62 provided by the end wall 57. The tab 60 may be of a resilient material which allows the tab to be snapped over the end wall 57 of the reservoir to be disposed between the upper end of the barrel and the reservoir preventing accidental, downward movement of the reservoir toward the bottle which would have the effect of opening the aperture 48 and permitting the infusion material in the reservoir, as shown in FIGS. 3 and 4, to escape into the bottle. Upon removal of the locking tab 60, the reservoir 52 may be intentionally depressed to open the aperture 48 surrounding the plunger head, such as shown in FIG. 4, whereby the contents of the reservoir may be discharged into the bottle. The engagement between the short cylindrical section 46 of the plunger head and the wall of the aperture 48 is a press fit so that infusion material in the reservoir will not seep into the bottle.

The inner and outer sleeve portions 28 and 30 come together at the of the threaded neck of the bottle and a sealing ring 64, such as an o-ring, may be utilized to seal the infusion cap on the bottle.

Figure 6:
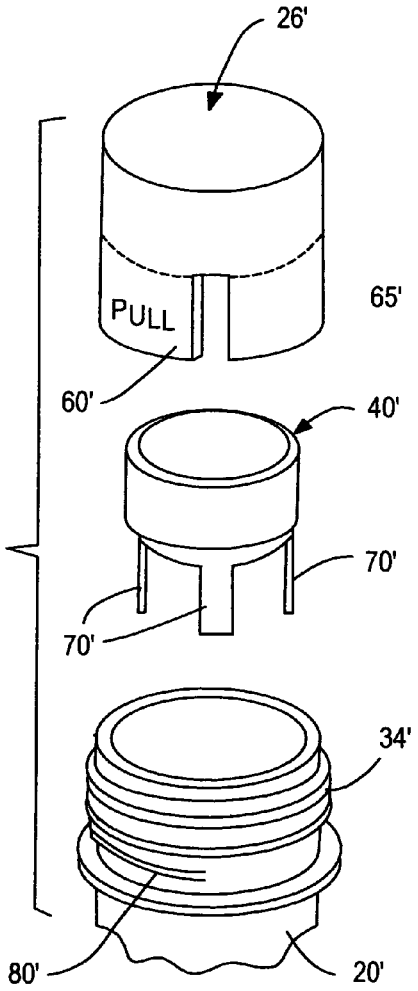
FIG. 6 is an exploded view of a second embodiment of our invention.
Figure 7:
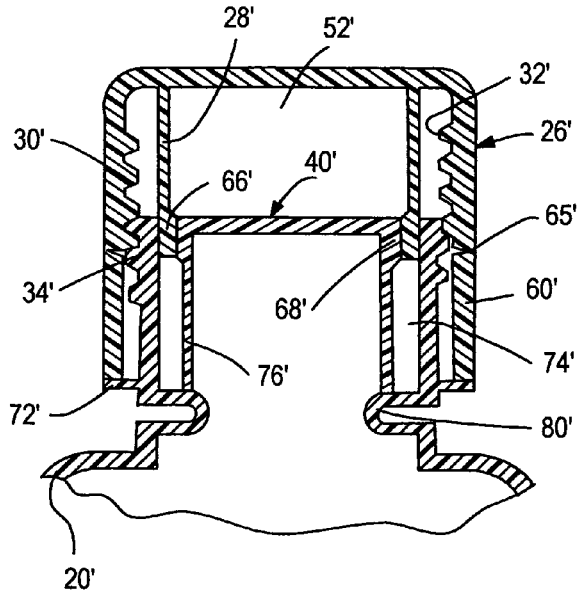
FIG. 7 is a cross-sectional view through our infusion cap shown in FIG. 6 and before the seal is broken between the infusion reservoir and the contents of the bottle or other container on which the cap is mounted.
Figure 8:
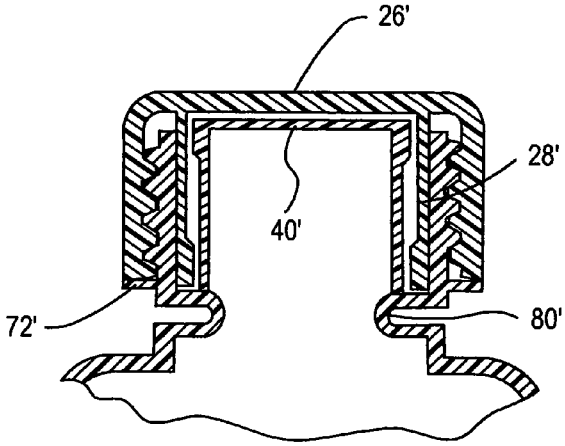
FIG. 8 shows the structure of FIG. 7 after the seal is broken.

In FIGS. 6, 7, and 8, we have shown a modification of the infusion cap on a bottle 20'. The infusion cap includes a barrel portion 26' having inner and outer sleeve portions 28' and 30.' The outer sleeve portion 30' has internal threads 32' for engaging the bottle threads 34.'

The lower end of the outer sleeve 30' has a circumferential weakened line 65' whereby the user may grasp portion 60' and peel it away from the upper half of the outer sleeve at the weakened area 65.' In this respect, the portion of the outer sleeve shown at 60' may be disengaged from the barrel or remainder of the outer sleeve 26' to enable the cap to be threaded down the bottle threads 34'.

Disposed within the cap is a plunger 40' which is a press fit within the inner sleeve 28.' The lower end of the inner sleeve 28' has a circumferential enlargement 66' bearing against an enlargement 68' on the plunger 40'. Upon threading the barrel 26' down the bottle threads, the enlargements 66' and 68' move out of sealed engagement permitting the contents of the reservoir to escape into the bottle 20.' The plunger 40' has a plurality of legs 70,' in this case there are four legs but only three are shown in FIG. 6, the other being equidistantly spaced between the adjacent legs. Thus, the material in the reservoir 52' can flow around the plunger 40' and into a space 74' between the legs 70' and then into the bottle 20.'

It will be noted that the lower end of the plunger sleeve 76' rests upon a shoulder 80' formed by a circumferential indentation of a bottle wall. The shoulder 80' prevents the plunger 40' from moving into the bottle and resists the pressure created when the barrel 26' is pressed downwardly toward the bottle to expel the contents of the reservoir into the bottle. It will also be noted that the bottle neck has a circumferential shoulder 72' upon which the locking tab 60' rests to prevent inward or downward movement of the plunger sleeve 76' during depression of the reservoir. In FIG. 8, we have shown the bottle cap when screwed down completely.

Figure 9:
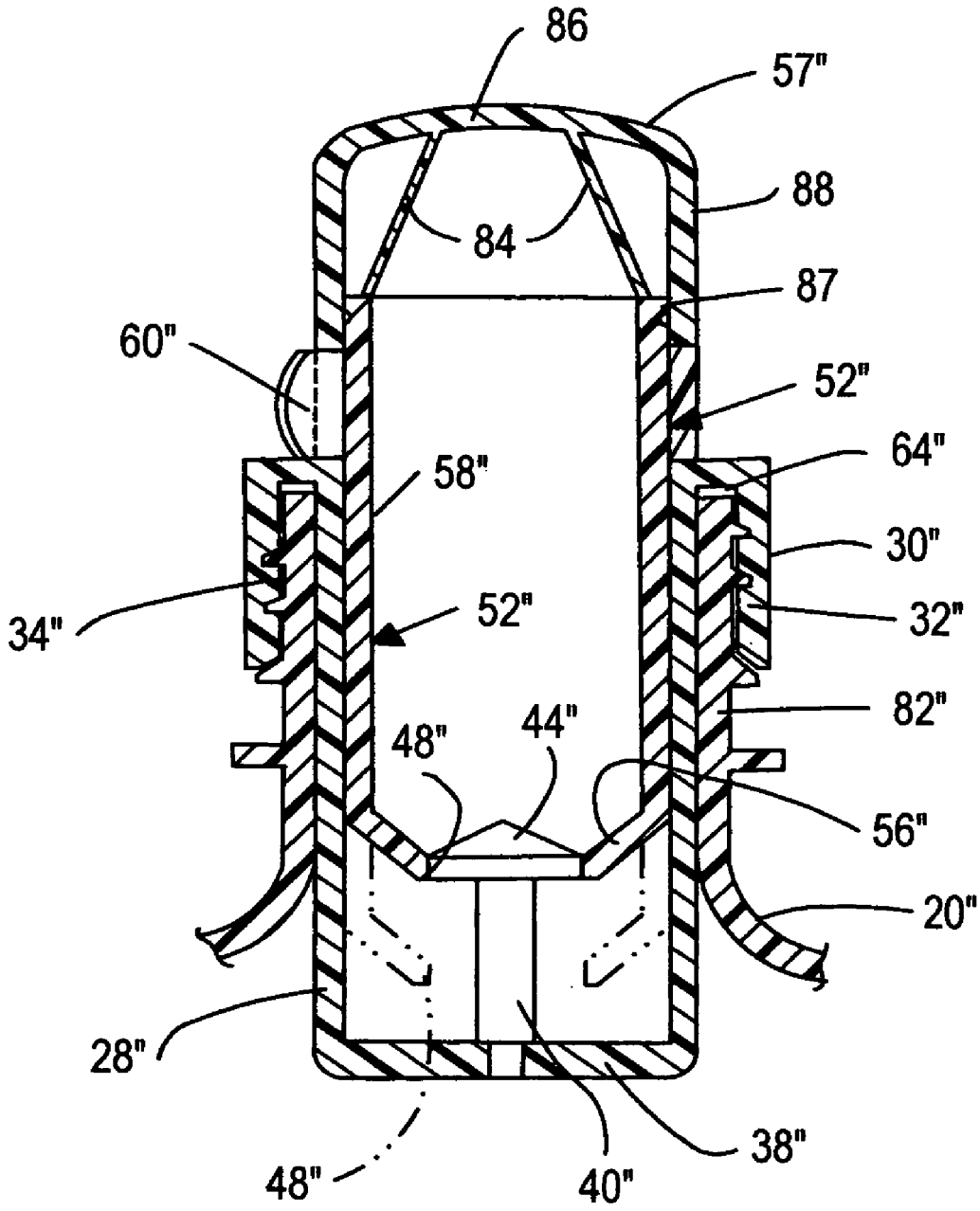
FIG. 9 is a cross-sectional view through an embodiment of the invention similar to FIG. 3.

In FIG. 9, we have shown an embodiment similar to that of FIG. 3 except the reservoir has a greater capacity for holding the infusion substance to be dispensed. The outer sleeve 30" is internally threaded at 32" so that it may be screwed onto the bottle threads 34." The inner sleeve 28" of the barrel is sized to be a slip fit within the bottle neck 82.' An o-ring seal or the like 64" is disposed at the upper end of the bottle neck and within the space between the inner and outer sleeves 28" and 30" to effect a seal between the cap and the upper end of the bottle neck.

A reservoir 52" having a cylindrical wall 58" closed at its lower end by an end wall 56" having an aperture 48" within which is pressed fit the conically shaped head 44" of a plunger 48". The opposite upper end of the reservoir is closed by a cupped shaped cap 57". Reinforcing legs 84 extend from the top of the cap to a junction 87 between the cylindrical wall 52" and the cylindrical wall 88 of the overlying cap. Such legs reinforce the cup 57" and prevent its collapse when it is pushed downwardly toward the bottle to open the aperture 48" in the lower end 56" of the reservoir 52". Upon pressing downwardly against the top cap 57", the reservoir is shifted downwardly toward the bottle and the plunger head 44" will be disposed above the lower wall of the reservoir to permit the infusion substance in the reservoir to be discharged into the bottle. The bottom wall 38" of the reservoir 52" is similar to the bottom wall 38 of FIGS. 3 and 5 so that the infusion substance may pass through the wall and into the bottle.

Figure 5:
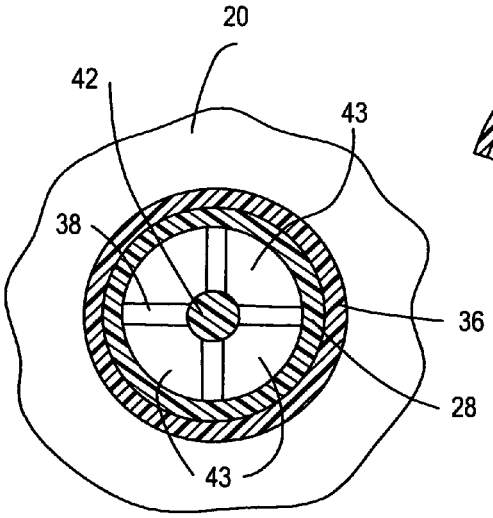
FIG. 5 is a cross-sectional view taken on a line 5-5 of FIG. 3.

As in the case of the first embodiment shown in FIGS. 3-5, a locking tab 60" may be provided between the lower end of the cap and the upper end of the barrel.

The construction of the reservoir and plunger in each of the embodiments is such that after the user causes the infusion cap to dispense its infusion substance into the bottle, the user may shake the bottle causing the substance in the bottle to be circulated back into the cap reservoir and from thence back into the bottle. This is the result of the openings 43 in the transverse wall and the large passageways around the plunger 40 as shown in FIG. 4.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An infusion cap for use on bottles having a cylindrical neck, comprising, in combination:

a barrel, having concentric respective inner and outer sleeve portions that serve to lock the barrel onto a bottle neck, and a plunger having a short cylindrical section concentric with the sleeve portions;

a reservoir disposed in the barrel in concentric relation therewith for containing a substance to be infused into a bottle upon which the cap is mounted;

said reservoir having an upper end and a lower end and being shiftable downwardly into the barrel;

said lower end of the reservoir having an aperture closed by said short cylindrical section of the plunger received in a sealed press fit in said aperture and blocking the escape of the substance to be infused in the reservoir until the reservoir is shifted downwardly;

the upper end of said reservoir being closed and extending upwardly beyond the sleeve portions, the upper end to be shifted downwardly for dispensing the substance to be infused into the bottle; and a locking tab for preventing inadvertent, downward shifting of the reservoir.

2. The infusion cap described in claim 1 wherein spaces are provided around the plunger and between the plunger and the reservoir to permit free passage of the infusion substance in the reservoir and the substance in the bottle back and forth after the reservoir and plunger are unsealed.

3. An infusion cap for use on bottles having an externally threaded neck, comprising, in combination:

a barrel having concentric respective inner and outer sleeve portions and a plunger having a short cylindrical section, the outer sleeve portion being internally threaded for engagement with the threaded neck of a bottle, and the inner sleeve portion receivable within the neck of the bottle opposite the outer sleeve portion;

said sleeve portions joined together to overlie the outer end of the bottle neck and form a seal therewith;

a reservoir disposed in the barrel in concentric relation therewith for containing a substance to be infused into a bottle upon which the cap is mounted;

said reservoir having an upper end and a lower end and being shiftable downwardly into the barrel;

said lower end of the reservoir having an aperture closed by said short cylindrical section of the plunger received in a sealed press fit in said aperture and blocking the escape of a substance to be infused in the reservoir until the reservoir is shifted downwardly;

the upper end of said reservoir being closed and extending upwardly beyond the sleeve portions, the upper end to be shifted downwardly for dispensing the substance to be infused into the bottle; and a locking tab for preventing inadvertent downward shifting of the reservoir.

4. The infusion cap defined by claim 3 wherein said locking tab is disposed between the upper end of the reservoir and the outer sleeve portion and is removable therefrom to permit downward movement of the reservoir.

5. The infusion cap defined by claim 3 wherein said plunger is mounted on the inner sleeve portion at the lowermost end thereof.

6. The infusion cap defined by claim 3 wherein said reservoir is shiftable downwardly over the plunger without the need to rotate the reservoir.

* * * * *